US006743161B2

(12) United States Patent
Dannemann et al.

(10) Patent No.: US 6,743,161 B2
(45) Date of Patent: Jun. 1, 2004

(54) METHOD OF SETTING THE FOLDING-NIP WIDTH OF A PLURALITY OF PAIRS OF FOLDING ROLLERS, AND FOLDING MACHINE IN WHICH THE METHOD CAN BE IMPLEMENTED

(75) Inventors: Georg-Dietrich Dannemann, Backnang (DE); Klaus Stocklossa, Rielingshausen (DE); Eberhard Krieger, Weinstadt-Strümpfelbach (DE)

(73) Assignee: Maschinenbau Oppenweiler Binder GmbH & Co. KG (DE)

( * ) Notice: Subject to any disclaimer, the term of this patent is extended or adjusted under 35 U.S.C. 154(b) by 0 days.

(21) Appl. No.: 10/315,146

(22) Filed: Dec. 10, 2002

(65) Prior Publication Data

US 2003/0109367 A1 Jun. 12, 2003

(30) Foreign Application Priority Data

Dec. 11, 2001 (EP) ..... 01129502

(51) Int. Cl.[7] ..... B31F 1/10

(52) U.S. Cl. ..... 493/442; 493/8; 493/23; 493/34; 493/419; 493/421

(58) Field of Search ..... 493/442, 8, 13–15, 493/17, 18, 23, 34, 419, 420, 421

(56) References Cited

U.S. PATENT DOCUMENTS 4,099,710 A * 7/1978 Boyer et al. ..... 493/420
4,125,254 A 11/1978 Boyer
5,242,364 A * 9/1993 Lehmann ..... 493/8
5,683,338 A * 11/1997 Krasuski et al. ..... 493/23
5,980,439 A * 11/1999 Johnson et al. ..... 493/14
6,024,682 A * 2/2000 Mandel et al. ..... 493/23
6,206,816 B1 * 3/2001 Cook et al. ..... 493/420

FOREIGN PATENT DOCUMENTS

DE 298 20 796 U1 2/1999
EP 0 511 488 A1 11/1992

* cited by examiner

*Primary Examiner*—Stephen F. Gerrity
*Assistant Examiner*—Hemant M. Desai
(74) *Attorney, Agent, or Firm*—Rothwell, Figg, Ernst & Manbeck, PC

(57) ABSTRACT

In the case of the method of setting the folding-nip width of a plurality of pairs of folding rollers which are provided on a folding machine, the two folding rollers (12 to 22) of the pairs of folding rollers are brought into contact with one another. A sheet is then guided through between the two folding rollers (12 to 22) of the pairs of folding rollers, as a result of which at least one of the two folding rollers (12 to 22) moves in relation to the other, with a folding nip being formed in the process, it being the case that, for each pair of folding rollers, a measured value corresponding to the folding-nip width is detected as the sheet is guided through. Finally, the folding-nip widths of the individual pairs of folding rollers are set by adjustment of the at least one moveable folding roller (14 to 22) by means of a drive (42), which is connected kinematically thereto, based on the corresponding measured values which have been detected.

4 Claims, 1 Drawing Sheet

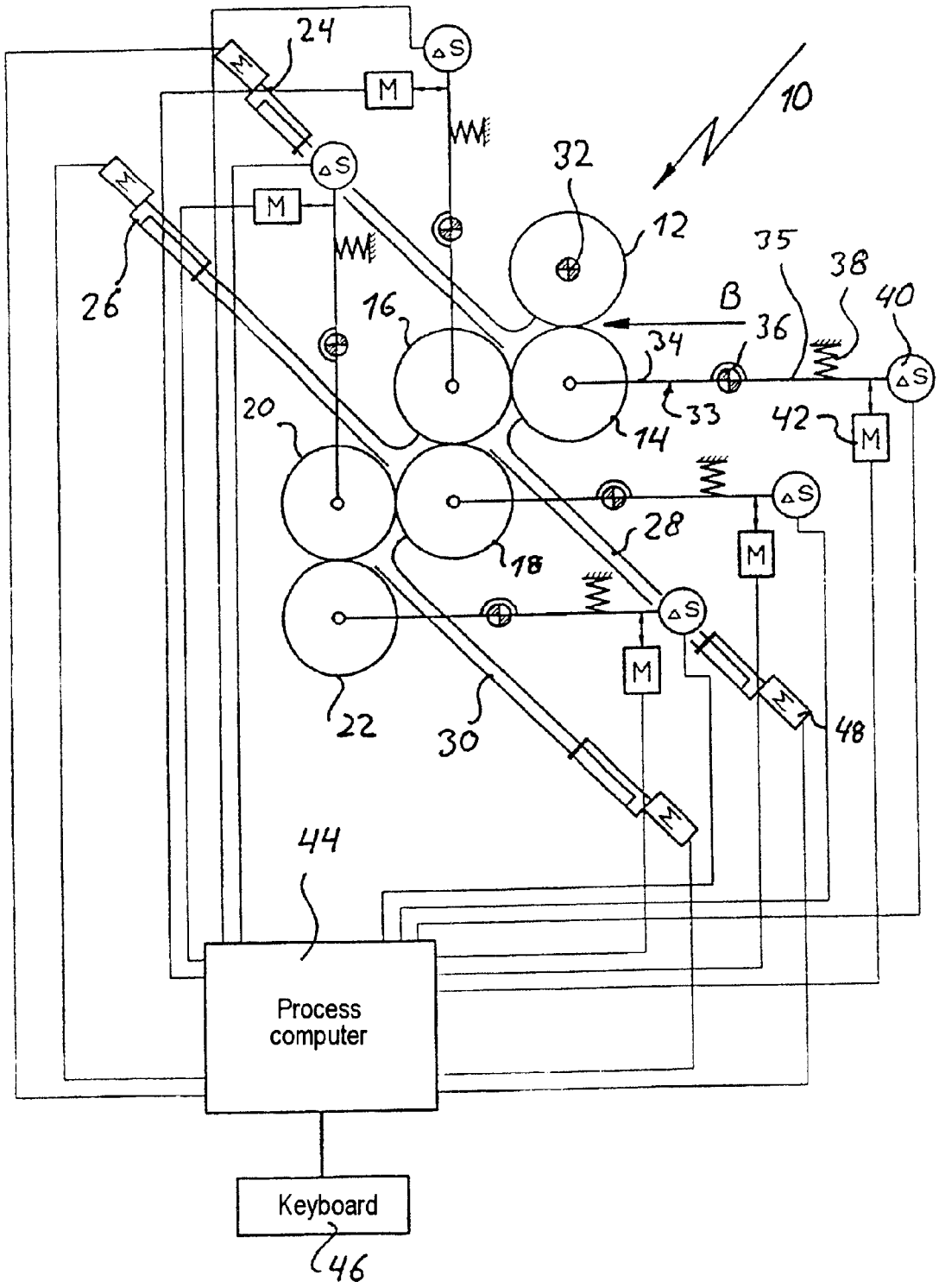
24
M
ΔS
10
32
12
35
38
40
26
16
B
36
34
33
42
14
20
28
18
22
30
48
44
Process computer
Keyboard
46

METHOD OF SETTING THE FOLDING-NIP WIDTH OF A PLURALITY OF PAIRS OF FOLDING ROLLERS, AND FOLDING MACHINE IN WHICH THE METHOD CAN BE IMPLEMENTED

BACKGROUND OF THE INVENTION

1. Field of the Invention

The invention relates to a method of setting the folding-nip width of a plurality of pairs of folding rollers which are provided on a folding machine.

2. Description of the Related Art

DE 298 20 796 U1 discloses a folding machine which has a plurality of pairs of folding rollers which are arranged one behind the other in the sheet-passage direction and between which one sheet is guided through in each case. One folding roller of the first pair of folding rollers is arranged in a stationary manner, while the other folding roller is arranged in an adjustable manner in order to form a folding nip with the other folding roller of the corresponding pair of folding rollers. The adjustable folding rollers are prestressed in the direction of the stationary roller in each case by a prestressing device. Arranged on the feed table of the known folding machine is a thickness-measuring device, which measures the thickness of a first passing sheet which is fed to the first pair of folding rollers. The measured value determined is passed on to a process computer. There, with a respective folding layout being taken into account, the necessary folding-nip widths are calculated. Thereafter, the actuating drives are actuated, in order to adjust the adjustable folding rollers, until actual values of position indicators correspond to the desired values which have been calculated. Corrections may be carried out both via a keyboard and via manual spindle drives, which act in parallel with the motor drives and also act on the position indicators.

Determining the necessary folding-nip width by computer is problematic because, in addition to the sheet thickness and the tolerances thereof, the setting values also have to take account of air inclusions, the sheet compression, the roller wear and the roller contamination (applications of ink and powder).

In the case of a further apparatus, which is known from U.S. Pat. No. 4,125,254, first of all all the folding-nip widths are set to zero. Then, a sample sheet is guided through the folder, as a result of which the adjustable folding rollers are deflected and arrested in this deflected position. Corrections to the folding-nip width, however, are not possible in the case of this folding machine, with the result that the operation of setting the folding-roller nip is not practicable.

SUMMARY OF THE INVENTION

The object of the invention is to provide a method of setting the folding-nip width of a plurality of pairs of folding rollers by means of which the folding-nip width can be automatically set, and corrected, in a straightforward and precise manner.

This object is achieved according to the invention by a method of setting a folding-nip width of a plurality of pairs of folding rollers which are provided on a folding machine, each pair of folding rollers including at least one adjustable folding roller, comprising the following steps:

- the two folding rollers of said pairs of folding rollers are brought into contact with one another,
- a sheet is passed between said two folding rollers of said pairs of folding rollers, whereby said at least one adjustable folding roller moves in relation to the other, so that a folding nip is formed, a value corresponding to said folding-nip width being detected for each pair of folding rollers as said sheet is passed therebetween, and
- said folding-nip widths of said pairs of folding rollers are set by adjustment of said at least one adjustable folding roller by means of a drive, which is connected kinematically thereto, based on the corresponding detected values which have been detected.

Since, in the case of the method according to the invention, the folding-nip width is measured on all the pairs of folding rollers as a sheet passes, and the folding-roller nip is then set by the associated drive at each pair of folding rollers in accordance with the measured values which have been detected, there is no need for any complicated calculation of the folding-nip widths in dependence on a thickness measurement, as is the case with the prior art known from DE-298 20 296. The method according to the invention operates without measuring the thickness of individual sheets and defective nip-width calculation. Moreover, it is possible to take account of air inclusions, the sheet compression, the roller wear and the roller contamination. Correction of the folding-nip widths is possible by the drives being activated correspondingly by a process control means, it being possible for the correction values to be entered from an operating terminal, e.g. a keyboard.

In the case of the method according to the invention, it is preferably possible for properties of a selected folding layout to be taken into account during the setting operation. Such folding layouts may be constituted, for example, by a zigzag fold or a parallel fold.

Furthermore, the measured values which have been detected may be compared with previously determined or measured reference values in order to determine roller wear or roller contamination.

The folding rollers are preferably brought into contact with one another by means of the drive, which is connected kinematically to an adjustable folding roller.

The method according to the invention can be used in a folding machine having

- a plurality of pairs of folding rollers which are arranged one behind the other in a sheet-passage direction and comprise an adjustable folding roller and a stationary folding roller or two adjustable folding rollers,
- each adjustable folding roller being associated a measuring device, which, as a sheet passes, detects a value corresponding to the width of the folding nip between said two folding rollers of a pair of folding rollers, and passes this value on to a process computer, and
- connected kinematically to each adjustable folding roller is a drive which is controlled by said process computer on the basis of said values, detected during sheet passage, on the corresponding pair of folding rollers in order to set an optimum width of said folding nip.

BRIEF DESCRIPTION OF THE DRAWING

An exemplary embodiment of the folding machine according to the invention will be explained in more detail with reference to the attached drawing, which shows, schematically, a buckle folder of a folding machine according to the invention.

DETAILED DESCRIPTION OF THE PREFERRED EMBODIMENTS

The buckle folder 10 has six folding rollers 12 to 22 which are arranged in parallel with one another and are arranged one after the other in the sheet-passage direction B. The folding rollers 12 to 22 form 5 pairs of folding rollers, the first pair of folding rollers being formed by a folding roller 12, which is mounted in a stationary position such that it can rotate, and the adjustable folding roller 14, the second pair of folding rollers being formed by the folding roller 14 and the adjustable folding roller 16, the third pair of folding rollers being formed by the folding roller 16 and the adjustable folding roller 18, the fourth pair of folding rollers being formed by the folding roller 18 and the adjustable folding roller 20, and the last pair of folding rollers being formed by the folding roller 20 and the adjustable folding roller 22.

In each case one buckle plate 24 to 30 is arranged downstream of the first to fourth pair of folding rollers.

The adjustability of the folding rollers 14 to 22 is explained in more detail hereinbelow with reference to the second folding roller 14. The folding roller 14 is mounted such that it can rotate at the free end of one arm 34 of a two-armed link 33, it being possible for the latter to be pivoted about a machine-mounted spindle 36. Acting on the second arm 35 of the link 33 is a compression spring 38, by means of which the folding roller 14 is prestressed in the direction of the folding roller 12. The second arm 35 of the link 33, furthermore, is connected kinematically to an actuating element 42 for the purpose of adjusting the folding-nip width between the folding rollers 12, 14. Moreover, the link 33 is assigned a displacement-measuring system 40, which measures the deflection ΔS of the link 33.

The actuating elements 42 and the displacement-measuring systems 40 are connected to a process computer 44, which controls the actuating elements 42 based on the measured values which have been detected by the displacement-measuring systems 40. Connected to the process computer 44, furthermore, is an operating panel 46 by means of which folding parameters and correction values can be entered into the process computer 44, which takes account of the same upon actuation of the actuating elements 42. Examples of controllable actuating elements 42 which can be used are electric spindle drives, linear motors, voice coil drives, hydraulic cylinders or pneumatic cylinders. The buckle plates 24 to 30 are provided, in a known manner, with actuating drives 48, by means of which the buckle plates can be set in accordance with the desired folding layout.

For the automatic setting of the folding-nip width, first of all the actuating drives 48 of all the buckle plates 24 to 30 are activated by the process computer 44, in dependence on the desired folding layout, and the buckle plates 24 to 30 are set. At the same time, all the actuating elements 42 acting on the links 33 are activated by the process computer 44 such that the folding rollers 12 to 22 of the individual pairs of folding rollers come into contact with one another, with the result that the width of the folding-roller nip is "0". In this case, the links 33 are prestressed by the compression springs 38 in the direction of the other folding roller of the pair of folding rollers.

If new folding rollers 12 to 22 are used, the displacement-measuring systems 40 may be adjusted or preset such that the displacement measured for the deflection of the link 33 is "0". The value "0" is used as reference value. If, during a subsequent automatic setting of the folding-roller nip, the deflection measured is greater than or less than 0 when the folding rollers are brought into contact, it can be established, as a result, that the folding rollers are either worn or contaminated.

For automatic setting of the folding-nip width, a sheet is introduced between the first pair of folding rollers 12, 14 and passes through the buckle folder 10 in accordance with the desired folding layout. In this case, the individual adjustable folding rollers 14 to 22 are deflected in accordance with the sheet thickness. This deflection corresponds to the width of the folding-roller nip which is optimal for processing following sheets. The deflection is measured in each case by the displacement-measuring system 40 and a corresponding measured value is passed on to the process computer. Thereupon, the process computer 44 controls the actuating elements 42 such that the deflection measured by the displacement-measuring system beforehand during first sheet passage is set. If appropriate, it is possible to enter correction values via the keyboard 46. This optimizes all the folding-roller nips for the passage of further sheets through the buckle folder 10.

A set value which has been determined by a sample sheet (1st sheet) forms a desired value for the roller-nip setting. This desired value may be compared continuously, in the production process, with the current actual value, as a result of which it is possible for changes in the folding-roller nip (e.g. by roller contamination, roller wear, change in paper thickness) to be established, and indicated, immediately in the production process.

What is claimed is:

1. Method of setting a folding-nip width of a plurality of pairs of folding rollers which are provided on a folding machine, each pair of folding rollers including at least one adjustable folding roller, comprising the following steps:

the two folding rollers of said plurality of pairs of folding rollers are brought into contact with one another, a sheet is passed between said two folding rollers of said plurality of pairs of folding rollers, whereby said at least one adjustable folding roller moves in relation to the other, so that a folding nip is formed, a value corresponding to said folding-nip width being detected for each of said plurality of pairs of folding rollers as said sheet is passed therebetween, and said folding-nip widths of said each pair of said plurality of pairs of folding rollers is set by adjustment of said at least one adjustable folding roller by means of a drive, which is connected kinematically thereto, based on the corresponding detected value which has been detected for the corresponding pair of folding rollers.

2. Method according to claim 1, wherein properties of a selected folding layout are taken into account during said setting.

3. Method according to claim 1, wherein said values which have been detected are compared with previously determined reference values in order to determine roller wear or roller contamination.

4. Method according to claim 1, wherein said folding rollers are brought into contact with one another by means of said drive, which is connected kinematically to at least one folding roller.

* * * * *